US005895693A

United States Patent [19]

Novak et al.

[11] Patent Number: 5,895,693

[45] Date of Patent: Apr. 20, 1999

[54] DECORATIVE PRODUCTS MADE FROM FILM STRIPS AND A METHOD OF MAKING SUCH PRODUCTS

[75] Inventors: Bernard Novak, Copenhagen N, Denmark; Linda Sundlin, 10770 Cushdon Ave., Los Angeles, Calif. 90064

[73] Assignee: Linda Sundlin, Los Angeles, Calif.

[21] Appl. No.: 08/629,837

[22] Filed: Apr. 11, 1996

[51] Int. Cl.[6] ..... B44C 5/04

[52] U.S. Cl. ..... 428/14; 428/102; 428/542.2

[58] Field of Search ..... 428/5, 7, 14, 102, 428/542.2, 904.4

[56] References Cited

U.S. PATENT DOCUMENTS

| | | | |
|---|---|---|---|
| 1,053,126 | 2/1913 | Fuller et al. | 428/5 X |
| 1,606,853 | 11/1926 | Trisler | 428/31 X |
| 1,755,818 | 4/1930 | Ganzinotti | 428/34.2 X |
| 3,753,825 | 8/1973 | Stock | 428/337 X |

OTHER PUBLICATIONS

Declaration of Bernard Novak dated Jul. 29, 1996.
Declaration of Linda Sundlin dated Jul. 24, 1996.
"Webster's Seventh New Collegiate Dictionary" The Title Page, The Verso of the Title Page and p. 134, copyright 1967.

*Primary Examiner*—Henry F. Epstein
*Attorney, Agent, or Firm*—Graham & James LLP

[57] ABSTRACT

Decorative products made using motion picture film and a process for making the products is provided. The decorative products include a room divider, a window covering, a wall hanging, and a lamp shade. The products are comprised of a plurality of strips of motion picture film arranged in a pattern and permanently attached together. The products are made by a process that comprises the steps of cutting a plurality of strips from motion picture film, laying the strips out to form a predetermined pattern, and permanently attaching the strips together in the predetermined pattern. The process may also include the steps of applying a protective coating to the strips, and fastening the strips to a mounting device suitable for mounting the strips to a ceiling, wall, or lamp.

8 Claims, 5 Drawing Sheets

DECORATIVE PRODUCTS MADE FROM FILM STRIPS AND A METHOD OF MAKING SUCH PRODUCTS

BACKGROUND OF THE INVENTION

1. Field of the Invention

This invention relates to decorative products made using strips of motion picture film and to a process of making such products.

2. Background

Thousands of motion pictures have been made in the past, and many more continue to be made each year. The process of making a motion picture begins with the filming of scenes. Once the scenes are filmed and the film is developed, the scenes are edited. Editing involves deleting unwanted portions of the scenes by literally cutting pieces from the developed film. The edited scenes are then spliced together to form a motion picture.

The pieces that are cut from the film during the editing process are commonly called "outtakes." The developed film that forms the motion picture is rarely used for any purpose other than to display the motion picture, and the outtakes are rarely used for any purpose at all. The present invention relates to a process for making decorative products using strips of film cut from developed film that forms a motion picture or from outtakes. The present invention also relates to decorative products made using the process.

SUMMARY OF THE INVENTION

The present invention relates to decorative products comprised of a plurality of strips of motion picture film arranged in a pattern and permanently attached together. The products include, but are not limited to, a room divider, a window covering, a wall hanging, and a lamp shade.

The present invention also relates to a process for making the decorative products. The process begins with the step of cutting strips from motion picture film. The strips are then laid out to form a predetermined pattern and permanently attached together in the predetermined pattern. A protective coating may be applied to the strips, and the strips may be fastened to a mounting device suitable for mounting to a ceiling, wall, lamp, etc.

DETAILED DESCRIPTION OF THE PREFERRED EMBODIMENT

This invention relates to decorative products made from strips of motion picture film and to a process of making such products. In the detailed description that follows, like element numerals are used to describe like elements in one or more of the figures.

Figure 1A:
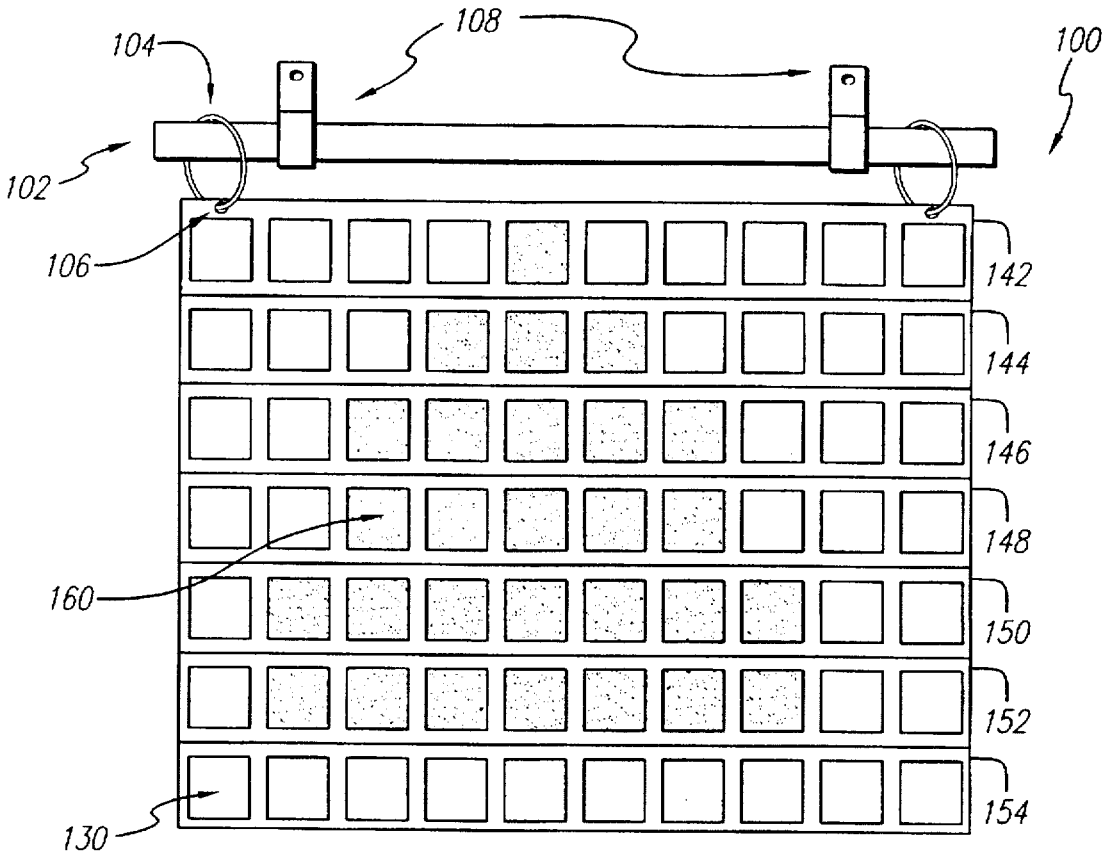
FIGS. 1*a*–1*b* illustrate exemplary decorative products of the present invention.

Referring first to FIG. 1*a*, an exemplary decorative product embodying the teachings of the present invention is shown. The decorative product 100 is comprised of strips of motion picture film 142–154, which are permanently attached together. Although the strips 142–154 in the exemplary decorative product shown in FIG. 1*a* are arranged horizontally, the strips could alternatively be arranged vertically or even diagonally.

The product may be fastened to a mounting device suitable for mounting on a wall, ceiling, lamp, stand, etc. In the exemplary decorative product shown in FIG. 1*a*, the mounting device comprises rings 104 and brackets 108 and a dowel 102. As shown in FIG. 1*a*, the rings pass through holes 106 in one of the strips and around the dowel 102, thereby fastening the strips 142–154 to the dowel. The dowel 102 is supported by the brackets 104, which may be attached, for example, to a wall (not shown).

Although the mounting device illustrated in the exemplary decorative product shown in FIG. 1*a* includes rings 106 and brackets 108 and a dowel 102, any mounting device sufficient for mounting the decorative product to a wall, ceiling, lamp, or stand may be used in place of the mounting device illustrated in FIG. 1*a*.

Figure 1B:
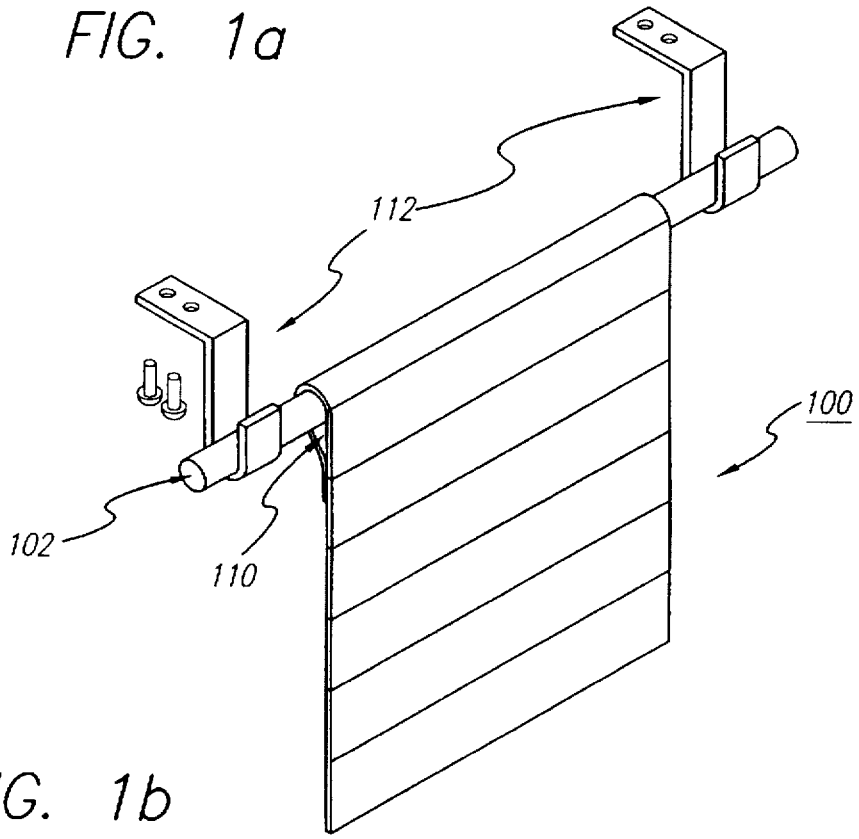

For example, as illustrated in FIG. 1*b*, a loop 110 may be formed at one end of the strips by wrapping that end of the strips back on itself as shown in FIG. 1*b*. A dowel 102 may then be inserted through the loop and supported by brackets 112. Any piece of material that is sufficiently rigid to support the weight of the product may be substituted for the dowel 102.

Figure 2:
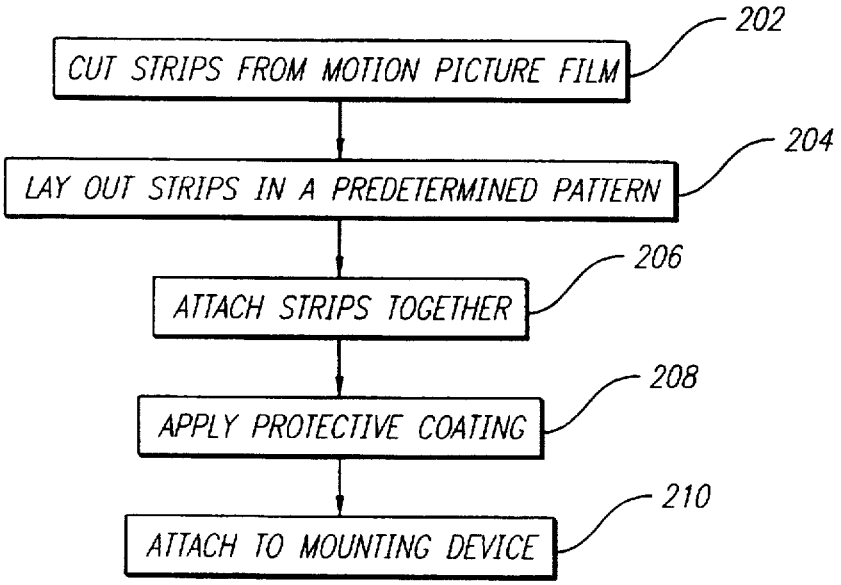
FIG. 2 shows a flow chart illustrating the process of the present invention.

The process of making a decorative product according to the teachings of the present invention will now be described with reference to FIG. 2. The first step in the process is to cut a plurality of strips from developed motion picture film 202. The film is preferably 35 mm or 70 mm color motion picture film. However, larger or smaller sized film may also be used, including 16 mm film and 180 mm IMAX film. In addition, black and white film may be used. The strips may be cut from a reel of film or from film outtakes.

The strips are cut such that they form a predetermined pattern when laid out in a predetermined fashion. Although the strips in the exemplary product illustrated in FIG. 1*a* form a rectangular pattern when laid side by side, the strips could alternatively be cut to form numerous other patterns, such as a triangular pattern, a circular pattern, or any other geometric pattern.

The strips 142–154 may also be cut such that objects, shapes, and/or colors in the strips form a decorative design when the strips are laid out in the predetermined pattern. As is known, motion picture film comprises a sequence of frames 130, each containing a still picture, and each still picture comprises various objects, shapes, and/or colors. In the exemplary product shown in FIG. 1*a*, the strips 142–154 have been cut such that objects, shapes, and/or colors in the frames 130 of the strips form a decorative design consisting of a dark colored triangle 160.

Figure 1C:
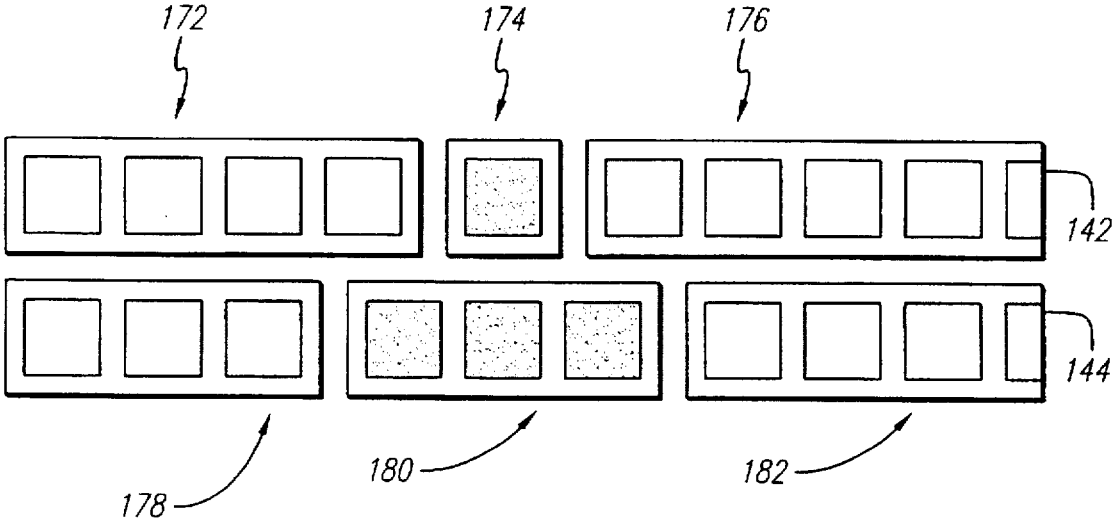
FIG. 1*c* illustrates strips of film comprised of multiple pieces of film.

Although each strip 142–154 in the exemplary product shown in FIG. 1*a* is a continuous strip, one or more of the strips could alternatively comprise multiple pieces of film that are attached together. For example, as shown in FIG. 1*c*, strip 142 could comprise three pieces of film 172, 174, 176 attached to each other. The exemplary decorative design 160 shown in FIG. 1*a* could thus alternatively be formed as shown in FIG. 1*c* by placing pieces of film containing frames with dark colors and/or images 174, 180 between pieces of film containing frames having light colors and/or images 172, 176, 178, 182.

Additionally, the appearance of the colors and/or shapes in a frame of a strip may be altered by attaching a piece of film to the strip such that a frame in the piece of film overlaps the frame of the strip. The colors and/or shapes in the overlapping frame of the piece of film would then appear to combine with the colors and/or shapes in the frame of the strip, altering the appearance of the frame of the strip. This technique for altering the appearance of a frame of a strip by attaching an overlapping piece of film to the strip may be used in creating the decorative design.

After the strips have been cut, the strips are laid out to form the predetermined pattern and the decorative design 204. Preferably, the strips are laid out on a light colored background, such as a light table. A light colored background facilitates viewing the objects, shapes, and/or colors in the frames of the strips, allowing the maker to verify that the desired decorative design has been achieved.

After the strips have been laid out in the predetermined pattern, the strips are permanently attached together in the predetermined pattern 206. The preferred method of attaching the strips together is to hand sew each strip to a neighboring strip. Alternatively, the strips may be machine sewn together. Still other methods may be used to attach the strips together, such as taping, clipping, stapling, or gluing.

After the strips have been permanently attached together in the predetermined pattern, a clear protective coating may be applied to the strips 208. The purpose of the protective coating is to protect the film from the effects of prolonged exposure to light and heat. As is known, prolonged exposure to light and heat causes film to become brittle. The protective coating is preferably a shellac.

After the strips have been permanently attached together, they may be fastened to a mounting device 210. As described above, any mounting device sufficient for mounting the decorative product to a wall, ceiling, lamp, or stand may be used, including the mounting devices shown in FIGS. 1*a*, 1*b*, and 3.

Numerous products can be made using the process of the present invention. For example, a room divider can be made using the above described process. In making a room divider, the strips are cut to form a pattern that is sufficiently large to divide a room. Once the strips have been permanently attached together, the strips are fastened to a mounting device that is suitable for mounting to the ceiling of a room. The strips are fastened to the mounting device such that the strips hang from the mounting device toward the floor of the room. An exemplary mounting device suitable for a room divider is illustrated in FIG. 1*b*.

A window covering is another example of a product that can be made using the process of the present invention. In making a window covering, the strips are fastened to a mounting device that is suitable for mounting on a wall above a window, such as the exemplary mounting device illustrated in FIG. 1*a*. Alternatively, the strips may be fastened to a mounting device that is suitable for mounting on the inside of a window frame.

Figure 3:
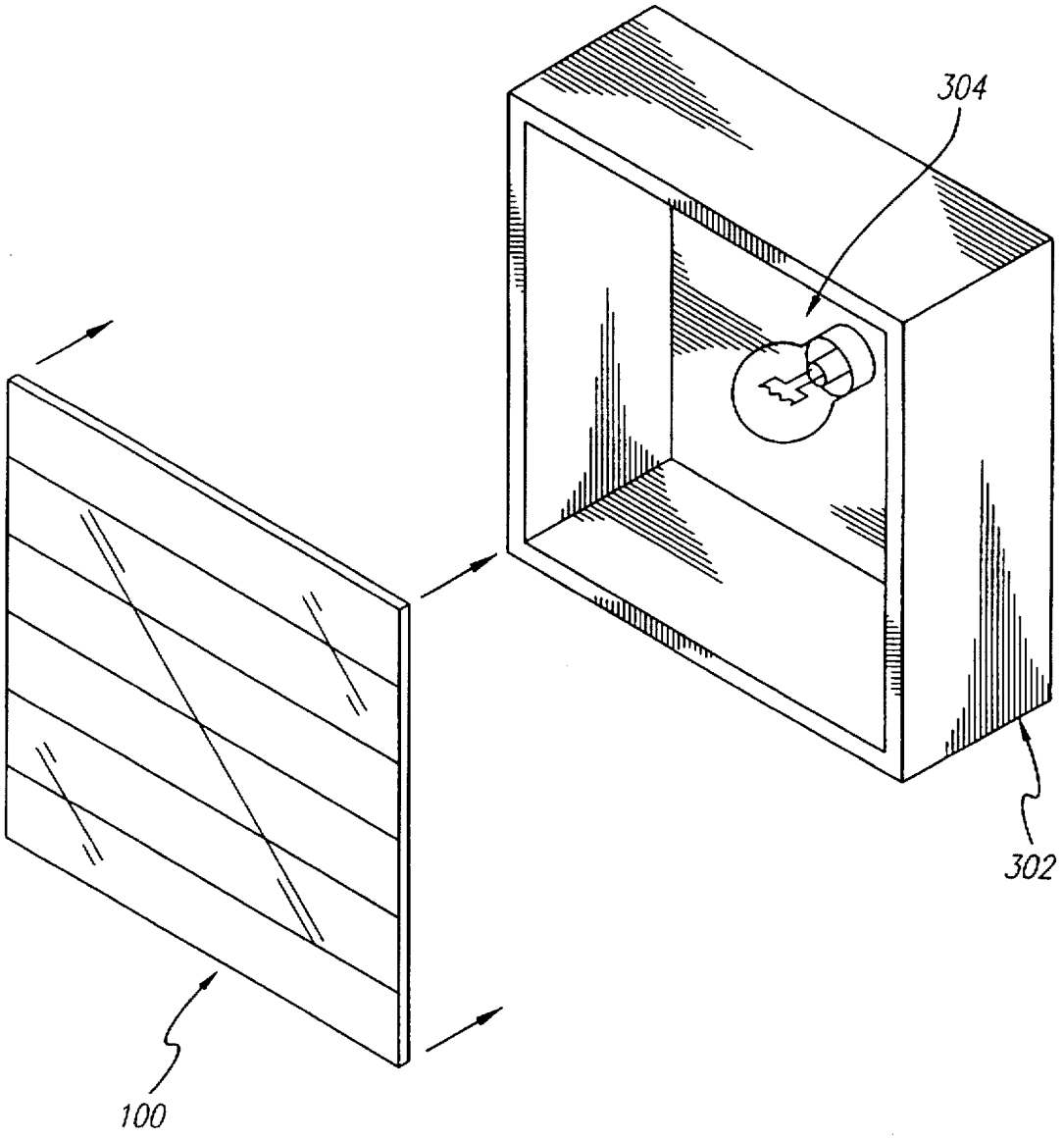
FIG. 3 illustrates an exemplary wall hanging fastened to a light box.

A wall hanging is still another example of a product that can be made using the process of the present invention. FIGS. 1*a* and 3 illustrate exemplary wall hangings. In making a wall hanging, the strips are fastened to a mounting device suitable for mounting on a wall, such as the exemplary mounting device illustrated in FIG. 1*a*. Alternatively, the mounting device may be a light box, such as the exemplary light box shown in FIG. 3, which includes a box 302 to which the strips are fastened and a light source 304.

Figure 4A:
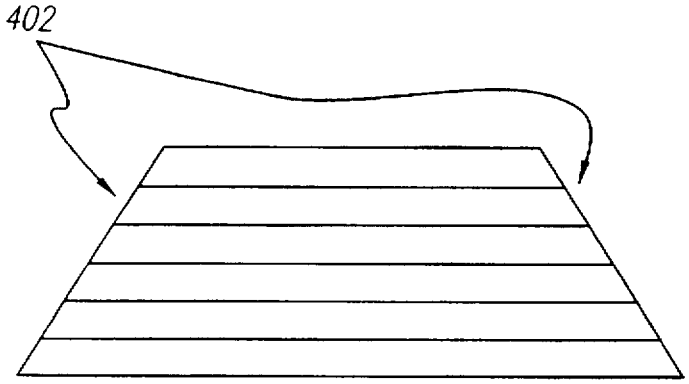
FIG. 4*a*–*c* illustrate an exemplary table lamp shade.
Figure 4B:
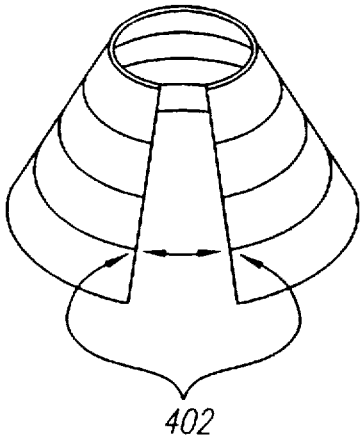
Figure 4C:
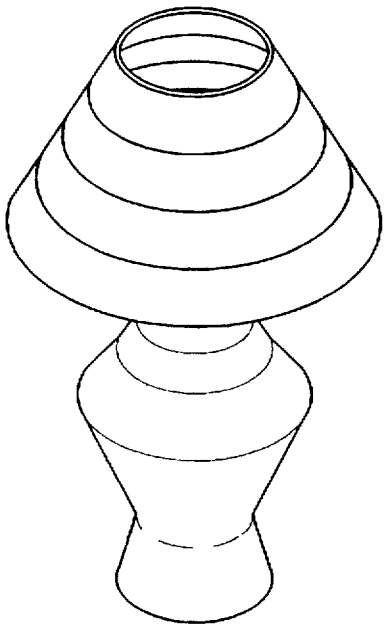

A lamp shade is yet another example of a product that can be made using the process of the present invention. After the strips have been attached together in the predetermined pattern as shown in FIG. 4*a*, opposite ends 402 of the strips may be attached together to form a shade for a table lamp as shown in FIG. 4*b*. Preferably, the opposite ends 402 are hand sewn together. However, the opposite ends 402 may alternatively be attached together by taping, clipping, stapling, or gluing. After the opposite ends 402 are attached together to form a lamp shade, the lamp shade is fastened to a device suitable for mounting the lamp shade on a lamp as shown in FIG. 4*c*.

Figure 4D:
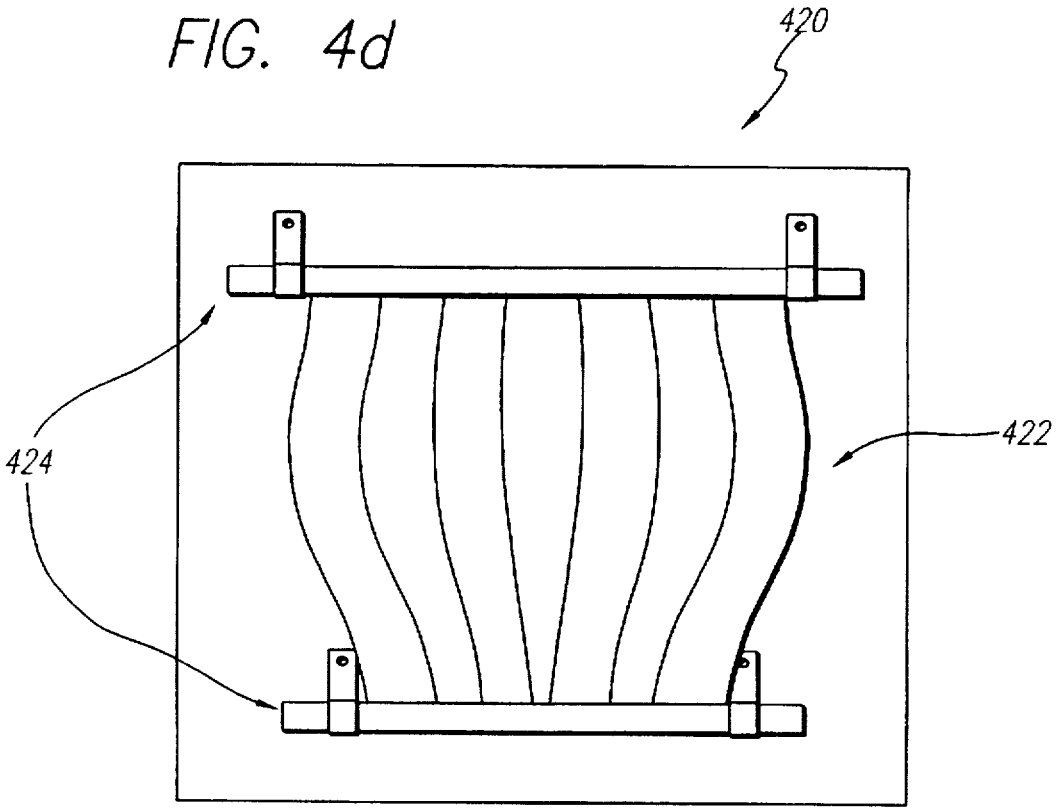
FIG. 4*d*–*e* illustrate an exemplary wall lamp shade.
Figure 4E:
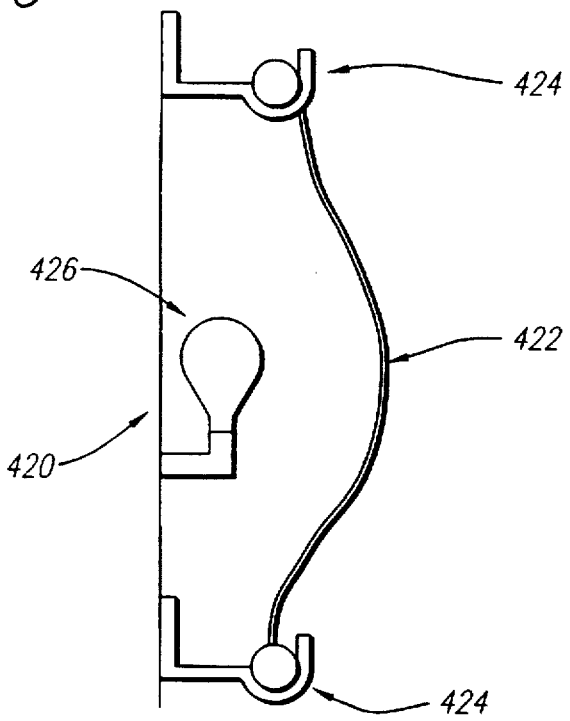

Alternatively, the process of the present invention may be used to make a lamp shade for a wall lamp. After the strips are permanently attached together in a predetermined pattern 422, the strips are mounted to a wall 420 in such a way as to cause the strips to flare out from the wall and cover a wall lamp 426 as shown in FIG. 4*d*, which illustrates a front view of a lamp shade for a wall lamp, and FIG. 4*e*, which illustrates a side view of the same lamp shade. Although the mounting devices 424 illustrated in FIGS. 4*d* and 4*e* are similar to the mounting device illustrated in FIG. 1*a*, any mounting device suitable for mounting on a wall may be used.

Having thus described a preferred embodiment of the invention, it should be apparent to those skilled in the art that various modifications, adaptations, and alternative embodiments thereof may be made within the scope and spirit of the invention. For example, although the step of applying a protective coating to the strips is described as occurring after the strips have been permanently attached together, the protective coating may alternatively be applied to the strips before they are attached together, or to the film before the strips are cut therefrom.

The invention is limited only by the following claims.

What is claimed is:

1. A decorative product comprised of:

a plurality of strips of developed motion picture film laid out in a predetermined pattern, each of said plurality of strips comprising at least one frame; and attaching means for attaching said plurality of strips together in said predetermined pattern, whereby the shapes and colors of said frames form a decorative design.

2. The product of claim 1, further comprising at least one additional strip of film attached to at least one of said plurality of strips such that at least one frame in said at least one additional strip of film overlaps at least one frame in said at least one of said plurality of strips, wherein said decorative design is formed at least in part by said overlapping frames.

3. The product of claim 1, further comprising a light box to which said plurality of strips are fastened.

4. The product of claim 1, wherein said attaching means comprises thread.

5. The product of claim 1, further comprising a mounting device to which said plurality of strips are fastened.

6. The product of claim 1, wherein said motion picture film comprises 35 mm motion picture film.

7. The product of claim 1, wherein said motion picture film comprises 70 mm motion picture film.

8. A decorative product comprising:

a plurality of strips of developed motion picture film arranged side by side to form a predetermined geometric patterns, each of said plurality of strips comprising at least one frame;

means for attaching each of said plurality of strips to at least one neighboring strip such that said plurality of strips are permanently fastened together in said predetermined geometric pattern, whereby the shapes and colors of said frames form a decorative design;

mounting means suitable for mounting in a room of a building; and means for fastening said plurality of strips to said mounting means.

* * * * *